US005488785A

United States Patent [19]

Culp

[11] Patent Number: 5,488,785

[45] Date of Patent: Feb. 6, 1996

[54] CONTROLLED UPPER ROW AIRFLOW METHOD AND APPARATUS

[76] Inventor: George Culp, 318 S. Main St., New London, Stanley County, N.C. 28127

[21] Appl. No.: 125,544

[22] Filed: Sep. 23, 1993

[51] Int. Cl.[6] ..... F26B 7/00

[52] U.S. Cl. ..... 34/307; 34/218

[58] Field of Search ..... 34/191, 218, 219, 34/307, 309, 310, 311

[56] References Cited

U.S. PATENT DOCUMENTS

| | | | |
|---|---|---|---|
| 15,316 | 3/1922 | Weiss . | |
| 217,022 | 7/1879 | Robbins . | |
| D. 328,137 | 7/1992 | Warrent et al. . | |
| 473,116 | 3/1892 | Hay . | |
| 528,496 | 10/1894 | Williams . | |
| 555,067 | 2/1896 | Bemis . | |
| 620,114 | 2/1899 | Ferrell . | |
| 620,869 | 3/1899 | Horton . | |
| 942,150 | 12/1909 | Tiemann . | |
| 1,054,597 | 2/1913 | Moore . | |
| 1,212,583 | 1/1917 | Tanner . | |
| 1,276,979 | 8/1918 | Sidman . | |
| 1,328,662 | 1/1920 | Fish, Jr. . | |
| 1,339,374 | 5/1920 | Buensod . | |
| 1,432,248 | 10/1922 | Hirt . | |
| 1,467,306 | 9/1923 | Carrier . | |
| 1,497,362 | 6/1924 | Dhe . | |
| 1,539,817 | 5/1925 | Thelen . | |
| 1,541,433 | 6/1925 | Nikaido . | |
| 1,594,549 | 8/1926 | Noel . | |
| 1,603,103 | 10/1926 | Anderson . | |
| 1,693,395 | 11/1928 | Lawton . | |
| 1,774,208 | 8/1930 | Mueller | 34/231 |
| 1,778,586 | 10/1930 | Cobb | 34/231 |
| 1,840,523 | 1/1932 | Mueller . | |
| 1,863,943 | 6/1932 | Rubin . | |
| 1,919,646 | 7/1933 | Woolhouse . | |
| 1,972,346 | 9/1934 | Juline . | |
| 1,989,998 | 2/1935 | Mueller | 34/231 |
| 1,995,675 | 3/1935 | Furbush | 34/222 |
| 2,085,634 | 6/1937 | Cobb . | |
| 2,213,668 | 9/1940 | Dundas et al. . | |
| 2,315,285 | 3/1943 | Dennington . | |
| 2,318,027 | 5/1943 | Sykes et al. . | |
| 2,380,518 | 7/1945 | Gottschalk et al. | 34/518 |
| 2,388,184 | 10/1945 | Ripper . | |
| 2,448,288 | 8/1948 | Alk . | |
| 2,538,888 | 1/1951 | Smith . | |
| 2,718,713 | 9/1955 | Bloxham . | |
| 2,736,108 | 2/1956 | Muyderman | 34/231 |
| 2,825,274 | 3/1958 | Kurth et al. | 44/261 |
| 3,129,071 | 4/1964 | Meredith | 34/231 |
| 3,149,932 | 9/1964 | Bachrich . | |
| 3,337,967 | 8/1967 | Smith . | |
| 3,386,186 | 6/1968 | Tiefenbach . | |

(List continued on next page.)

FOREIGN PATENT DOCUMENTS

| | | | |
|---|---|---|---|
| 699870 | 12/1964 | Canada | 34/488 |
| 3321673 | 12/1984 | Germany | 34/218 |
| 901772 | 1/1982 | U.S.S.R. | 34/488 |

*Primary Examiner*—Henry A. Bennett
*Attorney, Agent, or Firm*—Bell, Seltzer, Park & Gibson

[57] ABSTRACT

The kiln system for drying lumber to a predetermined moisture content according to the present invention includes a kiln chamber for enclosing a charge of green lumber consisting of at least one rectangular solid stack of lumber, a fan for circulating air through the kiln chamber and through the lumber in the kiln chamber to dry the lumber and a relatively lightweight covering overlying and substantially blanketing an upper row of the rectangular solid stacks of lumber. The relatively lightweight covering limits direct contact of the circulating air with the upper row of lumber and prevents excessive drying, warping or cracking of the upper row of lumber. Further, the covering is relatively thin such that the volume of lumber enclosed in the kiln chamber is maximized. The covering is preferably comprised of a substantially rigid material, such as a wooden or a metal sheet. In addition, the covering is preferably spaced from the upper row of lumber, such as by a number of spaced apart stickers disposed between the covering and the upper row of lumber for allowing a limited amount of circulating air to pass of over the upper row of lumber.

45 Claims, 2 Drawing Sheets

U.S. PATENT DOCUMENTS

| | | | |
|---|---|---|---|
| 3,598,067 | 8/1971 | Jones . | |
| 3,659,352 | 5/1972 | Cook . | |
| 3,675,600 | 7/1972 | Jones . | |
| 3,680,219 | 8/1972 | Koch . | |
| 3,716,004 | 2/1973 | Jones . | |
| 3,900,957 | 8/1975 | Denton et al. . | |
| 4,014,107 | 3/1977 | Bachrich . | |
| 4,188,878 | 2/1980 | Kahnau . | |
| 4,199,870 | 4/1980 | Arsenault . | |
| 4,250,629 | 2/1981 | Lewis . | |
| 4,343,095 | 8/1982 | Rosen et al. . | |
| 4,380,877 | 4/1983 | Poux | 34/225 |
| 4,663,860 | 5/1987 | Beall . | |
| 4,753,020 | 6/1988 | Brunner | 34/230 |
| 4,788,777 | 12/1988 | Davis . | |
| 4,955,146 | 9/1990 | Bollinger . | |
| 4,972,604 | 11/1990 | Breckenridge . | |
| 5,107,607 | 4/1992 | Mason | 34/191 |

CONTROLLED UPPER ROW AIRFLOW METHOD AND APPARATUS

FIELD OF THE INVENTION

The present invention relates to the field of kiln drying and, more particularly, to a kiln drying method and apparatus which controls the air flow over the upper row of lumber for more even drying of the lumber.

BACKGROUND OF THE INVENTION

Lumber which has recently been cut and machined contains a relatively large percentage of water and is referred to as green lumber. Prior to being used in construction or other applications which demand good grades of lumber, the green lumber must be dried. Drying removes a large amount of water from the lumber and significantly reduces the lumber is warping or cracking. Acceptable water content will vary with the application as well as the type of wood, however, in many circumstances, a moisture content of 19% or less is an acceptable water content.

Although lumber may be air dried, kiln drying accelerates and provides increased control over the drying process. In kiln drying, a charge of lumber is placed in a kiln chamber. A typical kiln chamber is a generally rectangular building which can be sealed to control the introduction and exhaust of air. Further, such kiln chambers typically have reversible fans for circulating the air through the chamber.

The charge of lumber placed in the kiln generally consists of a number of rectangular solid stacks of lumber. Each stack of lumber, in turn, typically consists of a number of vertically stacked, horizontal rows of lumber that form a rectangular solid. The horizontal rows are spaced apart for air to pass between the rows using wooden boards referred to as "stickers" that have a relatively small lateral cross-sectional area in relation to the lateral cross-sectional area of the lumber forming the stack. The stickers are generally spaced apart between each horizontal row to allow air to flow between the rows.

Typically, the stacks of lumber are placed on separate wheeled, flat bed cars which are mounted for movement on railroad-type tracks. Kilns may have any desired number of tracks. Multi-track kilns may therefore accept several stacks of lumber during each drying cycle.

In operation, a charge of green lumber is initially placed in a kiln chamber. After sealing the kiln chamber, the air within the kiln is heated to facilitate drying. The air may be heated in a number of ways such as by heat transfer from pipes extending through the kiln chamber in which steam flows. Alternatively, heated air may be introduced such as from a furnace. Kilns which utilize the introduction of heated air are typically referred to as direct fired kilns.

Fans generally positioned in upper portions of the kiln and above the stacked lumber circulate the heated air through the kiln chamber, including the stacks of lumber. Because the stickers provide spacing between the horizontal rows of lumber, the heated air passes between the rows of lumber and is in direct contact with both the upper and lower surfaces of the individual pieces of lumber. The fans continually recirculate the air through the kiln and the lumber to further dry the lumber. Periodically, a portion of the circulating air is exhausted from the kiln and additional air is introduced into the kiln. Typically, the additional air is heated in the kiln chamber, such as by heat transfer from the steam pipes. This periodic exhaust and replacement process allows circulating air which has absorbed a large amount of moisture from the green lumber to be removed, while drier air is introduced to accelerate the lumber's drying.

Within such kilns, the circulating air flows in a generally circular pattern. More particularly, fans above the stacks of lumber direct air laterally over the top of the lumber in a first direction. When the air contacts a first sidewall of the kiln chamber, the bulk of the air is forced downward by the fans and the ceiling of the kiln chamber. The circulating air subsequently flows through the spaces between the horizontal rows of lumber established by the stickers in a second, lateral direction opposite the first lateral direction. Upon contact with a second sidewall of the kiln chamber, the air rises and is recirculated by the fans through the lumber. Periodically, the fans are reversed such that the air flows in the opposite direction to provide generally consistent drying of the lumber.

The amount of drying of each piece of lumber in a given time period (or the time required to dry lumber to a desired moisture content) primarily depends upon the amount of air which moves across its surface, and the extent to which such air can extract moisture from the lumber. Because of its location, significantly more air flows over the top row of lumber than through the spaces between the other rows. Accordingly, the top row of lumber in each stack generally dries more than the other rows of lumber. As a result, if the majority of the wood in a stack is dried to a desired moisture content, the top row of lumber will typically dry much faster, and thus warp or crook. The warped wood is generally either sold as an inferior grade of lumber or discarded as scrap material. Although the wasted wood is just a small fraction of the entire stack, the high volume nature of the lumber business turns such small fractional losses into large gross losses.

In an attempt to prevent excessive warping of the top row of each stack of lumber, it is known to those skilled in the art to place weights on the top row of lumber. Such weights are typically concrete blocks or other heavy objects which prevent the lumber from warping. Weights, such as concrete blocks, however, occupy relatively large amounts of space in the kiln chamber that could otherwise be filled with additional lumber to be dried. Furthermore, objects in direct contact with the lumber cut off air circulation to the top surface all together. Accordingly, the drying capacity and efficiency of the kiln chamber is significantly diminished for each load, leading again to large gross losses and other inefficiencies.

OBJECT AND SUMMARY OF THE INVENTION

Therefore, it is an object of the present invention to provide a covering for limiting the amount of air circulating over the upper row of a stack of lumber in a kiln, and, accordingly, to prevent excessive drying of the upper row of lumber.

In one embodiment, the present invention includes a relatively thin covering for overlying and substantially blanketing the uppermost row of each stack of lumber enclosed within a kiln chamber. The covering limits the amount of circulating air directly contacting the uppermost row of lumber. Further, the thickness of the covering is less than the thickness of a row of lumber such that a maximum amount of lumber may be enclosed in the kiln chamber.

In another embodiment, the present invention includes a plurality of spaced apart stickers disposed between the covering and the upper row of each rectangular solid stack of lumber for allowing a limited amount of circulating air to pass over and to dry the uppermost row of lumber.

In yet another embodiment, the covering is comprised of a number of adjacent sheets substantially blanketing the upper row of lumber.

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments, and wherein:

DETAILED DESCRIPTION OF A PREFERRED EMBODIMENT

Figure 1:
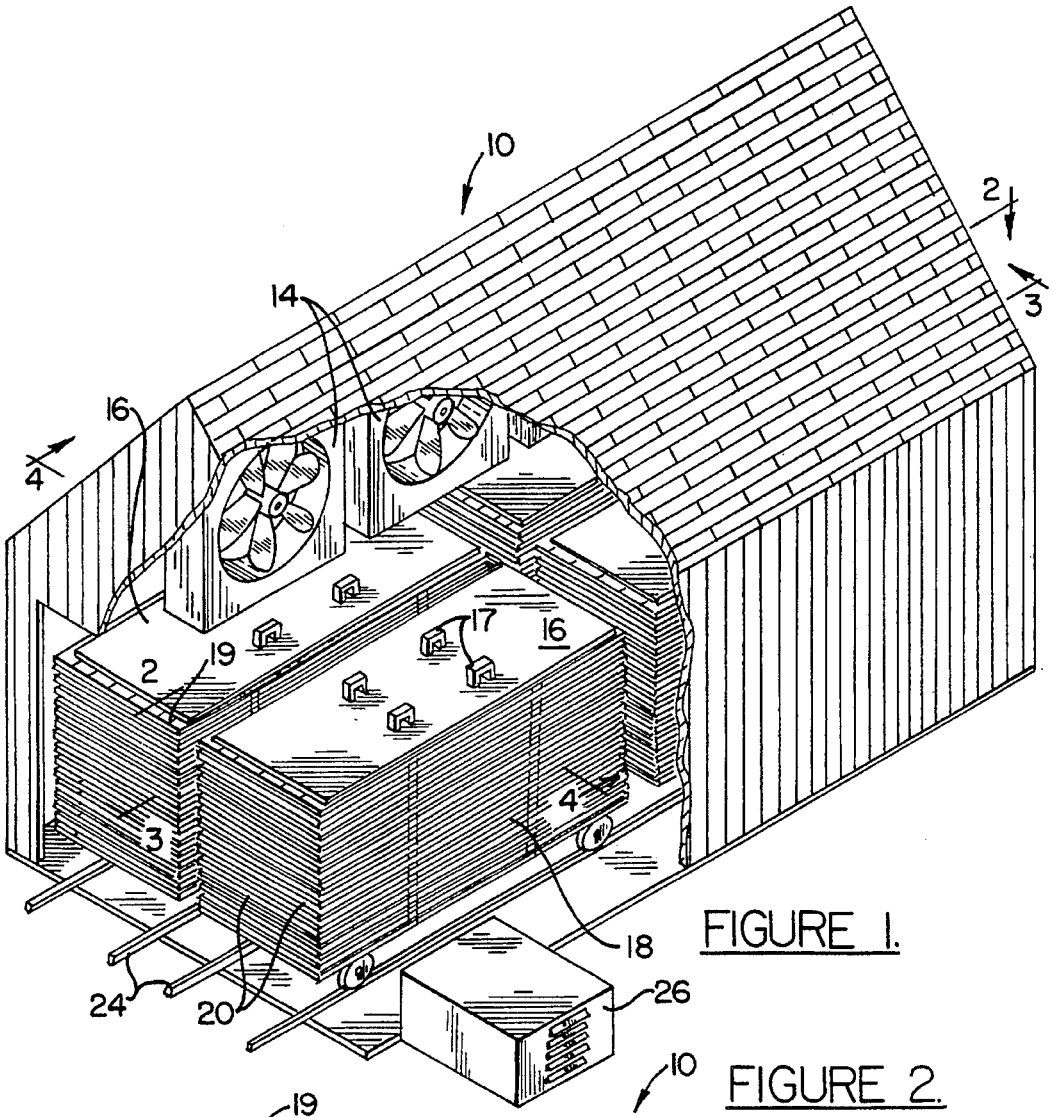
FIG. 1 is a fragmented perspective view of a kiln system according to the present invention.

The present invention is a method and apparatus for controlling the airflow over the upper row of lumber in a kiln chamber, thus, drying all of the green lumber more evenly. As illustrated in FIG. 1, a kiln chamber 10 for drying lumber is illustrated. The kiln chamber 10 has a lower portion defining a generally rectangular solid space for enclosing a charge of lumber. The charge of lumber typically includes a number of rectangular solid stacks of lumber 18. It will be understood, however, that the phrase "rectangular solid" is used descriptively rather than as a limitation and represents the general interior shape of a typical kiln, or the portion of some other shape of kiln that will hold a stack of lumber to be dried.

Figure 2:
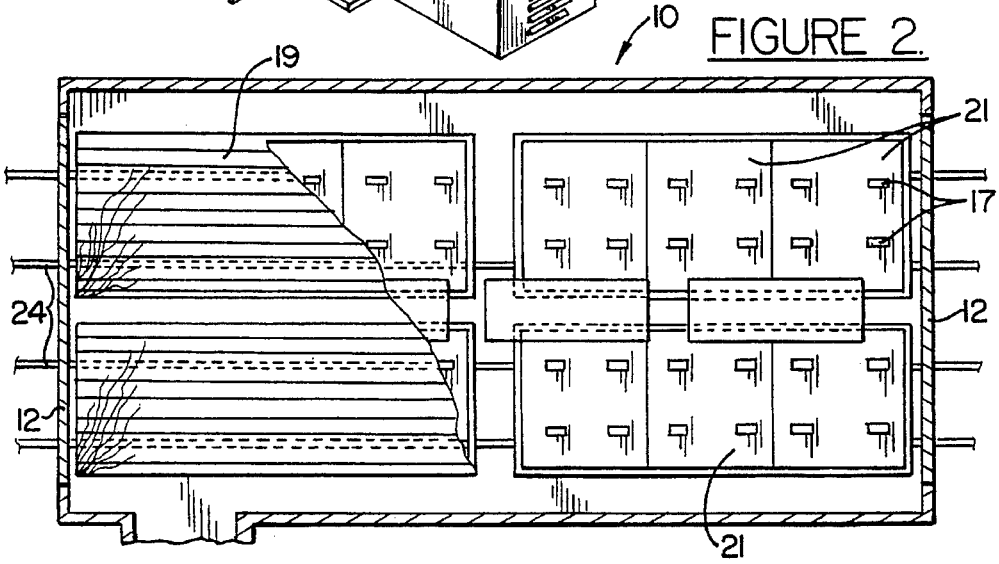
FIG. 2 is a cross-sectional plan view of the kiln system according to the present invention taken along line 2—2 of FIG. 1.

The kiln chamber 10 also preferably includes a set of doors 12 on one sidewall of the kiln chamber 10 and, more preferably, two sets of doors on opposed sidewalls. The doors 12 allow lumber to be inserted and withdrawn from the kiln chamber 10. For a kiln chamber 10 having two sets of doors 12 on opposed sidewalls as illustrated in FIG. 2, lumber may be inserted through a first set of doors and withdrawn from a second set of doors, thus increasing the efficiency of the lumber handling. The doors 12 also allow the kiln chamber 10 to be sealed to control the introduction and exhaust of air.

The kiln chamber 10 also includes at least one fan 14. More preferably, the kiln chamber 10 includes a plurality of longitudinally spaced fans 14 for circulating air laterally through the kiln chamber 10. The fans 14 are generally positioned in upper portions of the kiln chamber above the generally rectangular solid space. The fans 14 circulate air through the kiln chamber 10 and the lumber in the kiln chamber 10 in order to draw moisture from the lumber to dry the lumber to an acceptable moisture level. The fans 14 are also preferably reversible to allow the direction of airflow through the kiln chamber 10 to be altered so as to more evenly dry the lumber.

According to the present invention, a relatively thin covering 16 overlies and substantially blankets an uppermost row of the rectangular solid stacks of lumber 18. The covering 16 limits direct contact of the circulating air with the uppermost row of lumber 19. Preferably, the thickness of the covering 16 is less than the thickness of a row of lumber so that the space required in the kiln chamber 10 by the covering 16 is less than the space required by a row of lumber. Accordingly, the amount of lumber enclosed and dried in the kiln chamber 10 may be maximized and space within the kiln chamber 10 is not wasted. By limiting contact of the circulating air with the upper row of lumber 19, the thin covering 16 decreases the rate at which the upper row of lumber 19 dries and, accordingly, prevents warping or cracking of the upper row of lumber 19 prior to the drying of the remainder of the stack of lumber 18.

The covering 16 is preferably comprised of a substantially rigid material. More preferably, the covering 16 is a wooden or a metal sheet. Further, the relatively lightweight covering 16 preferably has a thickness less than about 1 inch so as to maximize the volume of the kiln chamber 10 available to receive green lumber.

As illustrated in the accompanying Figures, the upper surface of the covering 16 may include a number of substantially U-shaped handles 17. The handles 17 are preferably sized and spaced to permit a forklift the engage the handles 17 so as to thereby lift the covering 16 onto and remove the covering 16 from the upper row of lumber 19 prior to and following the lumber's drying, respectively.

However, the covering 16 may be placed upon the upper row of lumber 19 by other methods without departing from the spirit and scope of the present invention. For example, the covering 16 may be manually placed upon and removed from the upper row of lumber 19. Alternatively, the covering 16 may be suspended from upper portions of the kiln chamber 10 so as to be lowered onto the upper row of lumber 19 during the lumber's drying. Once the lumber was dry, the suspended covering 16 could be raised so that the lumber could be removed from the kiln chamber 10.

Figure 4:
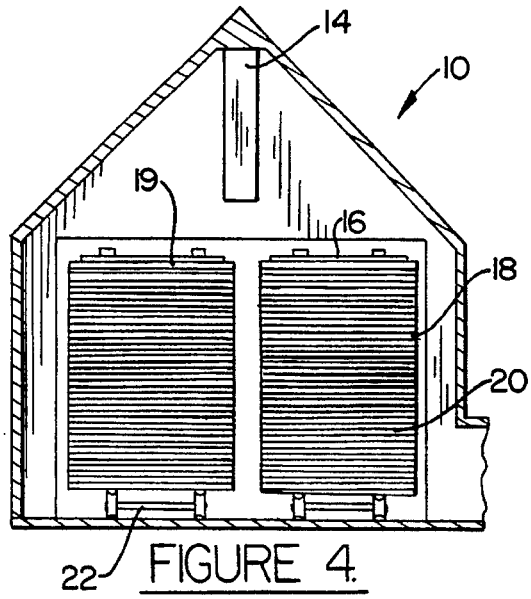
FIG. 4 is a cross-sectional lateral view of the kiln system according to the present invention taken along line 4—4 of FIG. 1.

In preferred embodiments, such as illustrated in FIG. 4, the kiln system for drying green lumber according to the present invention further includes a plurality of spaced apart stickers 20 disposed between the covering and the upper row of lumber 19. The stickers 20 are preferably wooden, and, more preferably, are pieces of lumber having cross-sectional dimensions which are relatively small in comparison to the cross-sectional dimensions of the pieces of lumber being dried. The stickers 20 allow a limited amount of circulating air to pass over the upper row of lumber 19 in order to sufficiently dry the upper row of lumber 19 without excessively drying and warping and cracking the upper row of lumber 19.

It will be understood, however, that the kiln system of the present invention need not include a plurality of stickers 20 to space the covering 16 from the upper row of lumber 19. If the covering 16 is not spaced from the upper row of lumber 19, it has been found that heat transfer from the circulating air to the upper row of lumber sufficiently dries the upper row of lumber 19.

In preferred embodiments, the plurality of stacked rows of lumber are also spaced apart such that air may flow between the rows to increase the lumber's drying. This spacing is also preferably provided by the placement of a plurality of spaced apart stickers 20 between each row of lumber as illustrated in FIG. 4.

In further preferred embodiments illustrated in FIG. 2, the covering 16 is comprised of a plurality of adjacent sheets 21 which substantially blanket the upper row of lumber 19. Accordingly, the sheets 21 which form the covering 16 need not be as large as the upper surface of the rectangular stack of lumber 18. Thus, relatively small sheets 21, such as sheets of plywood, may cover the upper row of lumber 19. The generally rectangular solid stacks of lumber 18 are typically placed on wheeled cars 22, such as flat bed rail cars, mounted on rail tracks 24 which are preferably formed in the floor of the kiln chamber 10. The wheeled cars 22 facilitate insertion and withdrawal of the stacks of lumber 18 from the kiln chamber 10. Although a kiln chamber 10 having two laterally adjacent tracks of lumber is illustrated, one skilled in the art will know that a kiln chamber incorporating the present invention may include one or more tracks of lumber.

Figure 3:
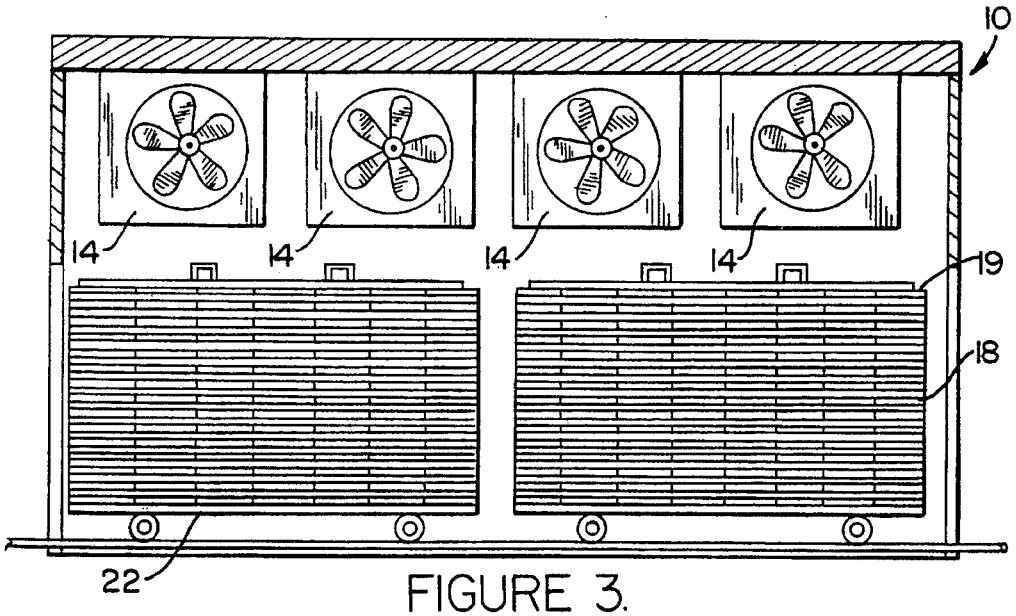
FIG. 3 is a cross-sectional side view of the kiln system according to the present invention taken along line 3—3 of FIG. 1.

Further, since the length of the kiln chamber 10 is typically greater than the length of the pieces of green lumber being dried, the charge of lumber preferably includes a longitudinal row of a plurality of rectangular solid stacks of lumber 18. Further, each longitudinal row of lumber is preferably inserted on one track with the wheeled cars upon which the rectangular solid stacks of lumber are carried being coupled together as illustrated in FIG. 3. Accordingly, the longitudinal row of lumber may be inserted and withdrawn as an unit. In embodiments in which the charge of lumber is comprised of a longitudinal row of a plurality of individual stacks of lumber 18, the covering 16 preferably overlies and substantially blankets the upper row of each stack of lumber 18 as illustrated in FIG. 2.

In further preferred embodiments, the kiln system of the present invention also includes means for heating the circulating air in the kiln chamber 10 since the circulation of heated air further accelerates the drying process by withdrawing larger quantities of moisture from the lumber. The heating means may include all those known to one skilled in the art, including, without limitation, an external furnace 26 for heating the air prior to its introduction to the kiln chamber 10. Alternatively, the kiln chamber 10 may include pipes extending through the kiln chamber 10 in which heated steam flows such that heat is transferred from the steam flowing through the pipes to the circulating air within the kiln chamber 10.

Figure 5:
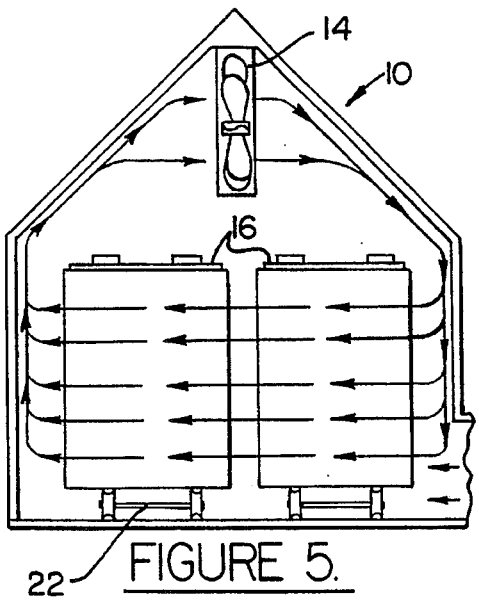
FIG. 5 is a cross-sectional lateral view of the kiln system according to the present invention illustrating a typical airflow pattern through the kiln chamber and through the lumber in the kiln chamber.

In operation, a charge of green lumber having a relatively large moisture content is introduced into the kiln chamber 10 which is subsequently sealed such that air may be controllably introduced into and exhausted from the kiln chamber 10. According to the present invention, the upper row of the rectangular solid stacks of lumber 19 of the charge of lumber is thereafter blanketed with a relatively lightweight covering 16 to eliminate direct contact of the circulating air with the upper row of lumber 19. As illustrated in FIG. 5, the air within the kiln chamber 10 is subsequently circulated through the kiln chamber 10 and through the stack of lumber 18 to draw moisture from the stack. Accordingly, excessive drying, warping and cracking of the upper row of lumber 19 is minimized.

In preferred embodiments, at least a portion of the air is recirculated through the stack of lumber 18 in the kiln chamber 10 to further dry the stack of lumber. This recirculation of air preferably includes the selective exhaust of a portion of the circulating air containing moisture drawn from the stack of lumber 18 and the introduction of additional air into the kiln chamber Preferably, the additional air has a lower moisture content than the exhausted air such that it will more rapidly draw moisture from the stack of lumber 18 than the exhausted air, thus, further increasing the efficiency of the drying process. In further preferred embodiments; the air is heated prior to its circulation to further facilitate moisture removal from the stack of lumber be. Once the lumber has reached an acceptable moisture level, such as 19% or less, or the lumber has been in the kiln chamber 10 for a predetermined length of time, the doors 12 of the kiln chamber be may be opened and the charge of lumber removed.

In the specification, typical preferred embodiments of the invention have been disclosed and, although specific terms have been employed, they have been used in the generic and descriptive sense only and not for purposes of limitation, the scope of the invention being set forth in the following claims.

What I claim is:

1. A kiln system for drying green lumber to a predetermined moisture content, said kiln system comprising:

a kiln chamber, lower portions of which define a generally rectangular solid space for enclosing a charge of lumber therein for drying, the charge of lumber comprising at least one rectangular solid stack of lumber;

a fan in upper portions of said kiln chamber and above the generally rectangular solid space for circulating air through said chamber and through lumber in said chamber to thereby dry the lumber; and a relatively thin covering for overlying and substantially blanketing the uppermost row of the rectangular solid stack of lumber for limiting direct contact of the circulating air with the uppermost row of lumber, said covering being positioned upon the rectangular solid stack of lumber and in contact with the uppermost row of the stack of lumber, the thickness of said covering being less than the thickness of a row of lumber so that the space required by said covering in said kiln chamber is less than the space required by a row of lumber to thereby maximize the amount of lumber that can be dried in said kiln chamber without waste.

2. A kiln system according to claim 1 wherein said covering is comprised of a substantially rigid material.

3. A kiln system according to claim 2 wherein said covering is a wooden sheet.

4. A kiln system according to claim 2 wherein said covering is a metal sheet.

5. A kiln system for drying green lumber to a predetermined moisture content, said kiln system comprising:

a kiln chamber, lower portions of which define a generally rectangular solid space for enclosing a charge of lumber therein for drying, the charge of lumber comprising at least one rectangular solid stack of lumber;

a fan in upper portions of said kiln chamber and above the generally rectangular solid space for circulating air through said chamber and through lumber in said chamber to thereby dry the lumber;

a relatively thin covering for overlying and substantially blanketing the uppermost row of the rectangular solid stack of lumber for limiting direct contact of the circulating air with the uppermost row of lumber, wherein the thickness of said covering is less than the thickness of a row of lumber so that the space required by said covering in said kiln chamber is less than the space required by a row of lumber to thereby maximize the amount of lumber that can be dried in said kiln chamber without waste; and a plurality of spaced apart stickers disposed between said covering and the uppermost row of lumber in a stack for allowing a limited amount of circulating air to pass between the uppermost row of lumber and said covering.

6. A kiln system according to claim 5 wherein said stickers are comprised of wood.

7. A kiln system according to claim 1 wherein said covering is comprised of a plurality of adjacent sheets substantially blanketing said upper row of lumber.

8. A kiln system according to claim 1 wherein the thickness of said relatively thin covering is less than about 1 inch.

9. A kiln system according to claim 1 wherein said covering includes a plurality of handles mounted upon an upper surface of said covering.

10. A covering for limiting direct contact of circulating air within a kiln chamber with the upper rows of rectangular solid stacks of lumber enclosed in the kiln chamber for drying, said covering comprising:

a relatively thin sheet overlying and substantially blanketing the upper rows of the rectangular solid stacks of lumber for limiting direct contact of the circulating air with the uppermost row of lumber, the thickness of said covering being less than the thickness of a row of lumber so that the space required by said covering in said kiln chamber is less than the space required by a row of lumber to thereby maximize the amount of lumber that can be dried in said kiln chamber without waste; and a plurality of spaced apart stickers disposed between said sheet and the upper rows of lumber for allowing a limited amount of circulating air to pass over the upper row of lumber to thereby draw moisture from the lumber.

11. A covering according to claim 10 wherein said sheet is comprised of a relatively rigid material.

12. A covering according to claim 11 wherein said sheet is comprised of wood.

13. A covering according to claim 11 wherein said sheet is comprised of metal.

14. A covering according to claim 10 wherein said plurality of stickers are comprised of wood.

15. A covering according to claim 10 further comprising a plurality of adjacent sheets overlying and substantially blanketing the upper row of lumber.

16. A covering according to claim 10 further comprising a plurality of handles mounted upon an upper surface of said covering.

17. A combination of a kiln system for drying green lumber to a predetermined moisture content and a charge of lumber, the combination comprising:

a kiln chamber, lower portions of which define a generally rectangular solid space;

a charge of lumber comprising at least one stack of lumber in the solid space for being dried;

a fan in upper portions of said kiln chamber and above the generally rectangular solid space for circulating air through said chamber and through lumber in said chamber to thereby dry the lumber; and a relatively thin covering for overlying and substantially blanketing the upper row of the rectangular solid stack of lumber for limiting direct contact of the circulating air with the uppermost row of lumber, said covering being positioned upon the rectangular solid stack of lumber and in contact with the uppermost row of the stack of lumber, the thickness of said covering being less than the thickness of a row of lumber so that the space required by said covering in said kiln chamber is less than the space required by a row of lumber to thereby maximize the amount of lumber that can be dried in said kiln chamber without waste.

18. A combination of a kiln system and lumber according to claim 17 wherein said covering is comprised of a substantially rigid material.

19. A combination of a kiln system and lumber according to claim 18 wherein said covering is a wooden sheet.

20. A combination of a kiln system and lumber according to claim 18 wherein said covering is a metal sheet.

21. A combination of a kiln system for drying green lumber to a predetermined moisture content and a charge of lumber, the combination comprising:

a kiln chamber, lower portions of which define a generally rectangular solid space;

a charge of lumber comprising at least one stack of lumber in the solid space for being dried;

a fan in upper portions of said kiln chamber and above the generally rectangular solid space for circulating air through said chamber and through lumber in said chamber to thereby dry the lumber;

a relatively thin covering for overlying and substantially blanketing the upper row of the rectangular solid stack of lumber for limiting direct contact of the circulating air with the uppermost row of lumber, wherein the thickness of said covering is less than the thickness of a row of lumber so that the space required by said covering in said kiln chamber is less than the space required by a row of lumber to thereby maximize the amount of lumber that can be dried in said kiln chamber without waste; and a plurality of spaced apart stickers disposed between said covering and said upper row of lumber for allowing a limited amount of circulating air to pass over said upper row of lumber.

22. A combination of a kiln system and lumber according to claim 21 wherein said stickers are comprised of wood.

23. A combination of a kiln system and lumber according to claim 17 wherein said covering is comprised of a plurality of adjacent sheets substantially blanketing said upper row of lumber.

24. A combination of a kiln system and lumber according to claim 17 wherein the thickness of said relatively thin covering is less than about 1 inch.

25. A combination of a kiln system and lumber according to claim 17 wherein said covering further comprises a plurality of handles mounted upon an upper surface of said covering.

26. A combination of a kiln system and lumber according to claim 17 wherein the charge of lumber is comprised of a longitudinal row of a plurality of rectangular solid stacks of lumber and wherein said covering overlies and substantially blankets the upper row of each stack of lumber.

27. A kiln system according to claim 5 wherein said covering is comprised of a substantially rigid material.

28. A kiln system according to claim 27 wherein said covering is a wooden sheet.

29. A kiln system according to claim 27 wherein said covering is a metal sheet.

30. A kiln system according to claim 5 wherein said covering is comprised of a plurality of adjacent sheets substantially blanketing said upper row of lumber.

31. A kiln system according to claim 5 wherein the thickness of said relatively thin covering is less than about 1 inch.

32. A kiln system according to claim 5 wherein said covering includes a plurality of handles mounted upon an upper surface of said covering.

33. A combination of a kiln system and lumber according to claim 21 wherein said covering is comprised of a substantially rigid material.

34. A combination of a kiln system and lumber according to claim 21 wherein said covering is comprised of a plurality of adjacent sheets substantially blanketing said upper row of lumber.

35. A combination of a kiln system and lumber according to claim 21 wherein the thickness of said relatively thin covering is less than about 1 inch.

36. A combination of a kiln system and lumber according to claim 21 wherein said covering further comprises a plurality of handles mounted upon an upper surface of said covering.

37. A combination of a kiln system and lumber according to claim 21 wherein the charge of lumber is comprised of a longitudinal row of a plurality of rectangular solid stacks of lumber and wherein said covering overlies and substantially blankets the upper row of each stack of lumber.

38. A kiln system for drying green lumber to a predetermined moisture content, said kiln system comprising:

a kiln chamber, lower portions of which define a generally rectangular solid space for enclosing a charge of lumber therein for drying, the charge of lumber comprising at least one rectangular solid stack of lumber;

a fan in upper portions of said kiln chamber and above the generally rectangular solid space for circulating air through said chamber and through lumber in said chamber to thereby dry the lumber; and a relatively thin covering for overlying and substantially blanketing the uppermost row of the rectangular solid stack of lumber for limiting direct contact of the circulating air with the uppermost row of lumber, wherein the thickness of said relatively thin covering is less than about 1 inch such that the thickness of said covering is less than the thickness of a row of lumber so that the space required by said covering in said kiln chamber is less than the space required by a row of lumber to thereby maximize the amount of lumber that can be dried in said kiln chamber without waste.

39. A kiln system according to claim 38 wherein said covering is comprised of a substantially rigid material.

40. A kiln system according to claim 38 further comprising a plurality of spaced apart stickers disposed between said covering and the uppermost row of lumber in a stack for allowing a limited amount of circulating air to pass between the uppermost row of lumber and said covering.

41. A kiln system according to claim 38 wherein said covering is comprised of a plurality of adjacent sheets substantially blanketing said upper row of lumber.

42. A kiln system for drying green lumber to a predetermined moisture content, said kiln system comprising:

a kiln chamber, lower portions of which define a generally rectangular solid space for enclosing a charge of lumber therein for drying, the charge of lumber comprising at least one rectangular solid stack of lumber;

a fan in upper portions of said kiln chamber and above the generally rectangular solid space for circulating air through said chamber and through lumber in said chamber to thereby dry the lumber; and a relatively thin covering for overlying and substantially blanketing the uppermost row of the rectangular solid stack of lumber for limiting direct contact of the circulating air with the uppermost row of lumber, wherein said covering includes a plurality of handles mounted upon an upper surface of said covering, and wherein the thickness of said covering being less than the thickness of a row of lumber so that the space required by said covering in said kiln chamber is less than the space required by a row of lumber to thereby maximize the amount of lumber that can be dried in said kiln chamber without waste.

43. A kiln system according to claim 42 wherein said covering is comprised of a substantially rigid material.

44. A kiln system according to claim 42 further comprising a plurality of spaced apart stickers disposed between said covering and the uppermost row of lumber in a stack for allowing a limited amount of circulating air to pass between the uppermost row of lumber and said covering.

45. A kiln system according to claim 42 wherein said covering is comprised of a plurality of adjacent sheets substantially blanketing said upper row of lumber.

* * * * *